US011828285B2

(12) United States Patent
De Bock et al.

(10) Patent No.: US 11,828,285 B2
(45) Date of Patent: Nov. 28, 2023

(54) LIQUID RING PUMP CONTROL

(71) Applicant: Edwards Technologies Vacuum Engineering (Qingdao) Co. Ltd., Qingdao (CN)

(72) Inventors: Andries Daniel Jozef De Bock, Qingdao (CN); Joeri Coeckelbergs, Cologne (DE); Xin Dai, Qingdao (CN); Xibo Liu, Qingdao (CN)

(73) Assignee: Edwards Technologies Vacuum Engineering (Qingdao) Company Limited, Qingdao (CN)

( * ) Notice: Subject to any disclaimer, the term of this patent is extended or adjusted under 35 U.S.C. 154(b) by 215 days.

(21) Appl. No.: 16/978,566

(22) PCT Filed: Oct. 25, 2018

(86) PCT No.: PCT/CN2018/111867
§ 371 (c)(1),
(2) Date: Sep. 4, 2020

(87) PCT Pub. No.: WO2019/174239
PCT Pub. Date: Sep. 19, 2019

(65) Prior Publication Data

US 2021/0017989 A1 Jan. 21, 2021

(30) Foreign Application Priority Data

Mar. 14, 2018 (GB) ..... 1804107

(51) Int. Cl.
*F04C 19/00* (2006.01)
*F04C 25/02* (2006.01)
(Continued)

(52) U.S. Cl.
CPC ..... *F04C 19/005* (2013.01); *F04C 7/00* (2013.01); *F04C 19/00* (2013.01); *F04C 19/001* (2013.01);
(Continued)

(58) Field of Classification Search
CPC ..... F04C 19/004; F04C 25/02; F04C 19/001; F04C 19/005; F04C 19/00; F04C 28/24;
(Continued)

(56) References Cited

U.S. PATENT DOCUMENTS 3,289,918 A * 12/1966 Adams ..... F04C 19/004 417/68
4,655,688 A 4/1987 Bohn et al.
(Continued)

FOREIGN PATENT DOCUMENTS

CA 2235248 A1 10/1999
CH 573553 A5 3/1976
(Continued)

OTHER PUBLICATIONS

Translation of the First Office Action and Search Report from counterpart Chinese Application No. 201880091210.2 dated Dec. 20, 2021, 13 pp.
(Continued)

*Primary Examiner* — Peter J Bertheaud
(74) *Attorney, Agent, or Firm* — Shumaker & Sieffert, P.A.

(57) ABSTRACT

A system comprising: a suction line; a liquid ring pump coupled to the suction line, the liquid ring pump comprising a chamber and an impeller mounted within the chamber; a non-return valve arranged to permit fluid to flow into the chamber via the suction line and to prevent or oppose fluid flow out of the chamber to the suction line; a gas line coupled to the liquid ring pump such that a gas may flow into
(Continued)

the liquid ring pump via the gas line, the gas line coupled to the liquid ring pump between the non-return valve and the chamber; a valve disposed on the gas line; and a controller configured to control the valve.

12 Claims, 6 Drawing Sheets

(51) Int. Cl.
*F04C 29/12* (2006.01)
*F04C 7/00* (2006.01)
*F04C 28/24* (2006.01)

(52) U.S. Cl.
CPC ..... *F04C 19/004* (2013.01); *F04C 19/007* (2013.01); *F04C 25/02* (2013.01); *F04C 28/24* (2013.01); *F04C 29/126* (2013.01)

(58) Field of Classification Search
CPC ..... F04C 7/00; F04C 19/007; F04C 29/126; F04C 29/042
See application file for complete search history.

(56) References Cited

U.S. PATENT DOCUMENTS 4,753,711 A * 6/1988 Bolton ..... D21F 1/48 415/36
9,964,110 B2 5/2018 Kosters et al.
10,047,747 B2 8/2018 Kosters et al.
2015/0030467 A1 1/2015 Spiess
2015/0361979 A1 12/2015 Kosters et al.

FOREIGN PATENT DOCUMENTS

| | | | |
|---|---|---|---|
| CN | 104114869 | A | 10/2014 |
| CN | 105026758 | A | 11/2015 |
| CN | 205330977 | U | 6/2016 |
| CN | 106089716 | A | 11/2016 |
| CN | 206111560 | U | 4/2017 |
| EP | 0169336 | A1 | 1/1986 |
| GB | 2282413 | A | 4/1995 |
| JP | S5949388 | A | 3/1984 |
| KR | 20160049846 | A | 5/2016 |

OTHER PUBLICATIONS

"Operating & Maintenance Manual for Liquid Ring Vacuum Pumps, Compressors & Systems," Travaini Pumps USA; TRH-TRS-TRM-TRV-SA, Apr. 1, 2002, pp. 29-30 & 39.
Extended Search Report from counterpart European Application No. 16/978,566 dated Dec. 20, 2021, 8 pp.
Written Opinion and International Search Report dated Feb. 11, 2019 from counterpart International Application No. PCT/CN2018/111867, 10 pp.

* cited by examiner

LIQUID RING PUMP CONTROL

This application is a national stage entry under 35 U.S.C. § 371 of International Application No. PCT/CN2018/111867, filed Oct. 25, 2018, which claims the benefit of GB Application 1804107.9, filed Mar. 14, 2018. The entire contents of International Application No. PCT/CN2018/111867 and GB Application 1804107.9 are incorporated herein by reference.

TECHNICAL FIELD

The present disclosure relates to the control of liquid ring pumps.

BACKGROUND

Liquid ring pumps are a known type of pump which are typically commercially used as vacuum pumps and as gas compressors. Liquid ring pumps typically include a housing with a chamber therein, a shaft extending into the chamber, an impeller mounted to the shaft, and a drive system such as a motor operably connected to the shaft to drive the shaft. The impeller and shaft are positioned eccentrically within the chamber of the liquid ring pump.

In operation, the chamber is partially filled with an operating liquid (also known as a service liquid). When the drive system drives the shaft and the impeller, a liquid ring is formed on the inner wall of the chamber, thereby providing a seal that isolates individual volumes between adjacent impeller vanes. The impeller and shaft are positioned eccentrically to the liquid ring, which results in a cyclic variation of the volumes enclosed between adjacent vanes of the impeller and the liquid ring.

In a portion of the chamber where the liquid ring is further away from the shaft, there is a larger volume between adjacent impeller vanes which results in a smaller pressure therein. This allows the portion where the liquid ring is further away from the shaft to act as a gas intake zone. In a portion of the chamber where the liquid ring is closer to the shaft, there is a smaller volume between adjacent impeller vanes which results in a larger pressure therein. This allows the portion where the liquid ring is closer to the shaft to act as a gas discharge zone.

Examples of liquid ring pumps include single-stage liquid ring pumps and multi-stage liquid ring pumps. Single-stage liquid ring pumps involve the use of only a single chamber and impeller. Multi-stage liquid ring pumps (e.g. two-stage) involve the use of multiple chambers and impellers connected in series.

SUMMARY

Liquid ring pumps may be used with a non-return valve at or proximate to the inlet of the liquid ring pump. The non-return valve may be configured to permit gas to be pumped into the liquid ring pump, and to prevent or oppose the flow of gas in the opposite direction, i.e. out of the liquid ring pump inlet.

The present inventors have realised that, on start-up (i.e. when the liquid ring pump begin to pump gas after a period of inactivity), the non-return valve can open only relatively slowly, e.g. over several seconds. The present inventors have further realised that this may lead to cavitation occurring within the liquid ring pump at start-up. Cavitation tends to be a significant cause of wear and failure in certain liquid ring pumps, especially those operating at a low-pressure/ high-vacuum condition. Also, start-up cavitation can lead to a disturbing noise. Thus, it tends to be desirable to prevents or oppose start-up cavitation in a liquid ring vacuum pump.

The present inventors have further realised that start-up cavitation can be reduced or eliminated by, during start-up of the liquid ring pump, introducing a flow of air into the inlet manifold of the liquid ring pump, after the non-return valve.

In a first aspect, the present disclosure provides a system comprising: a suction line; a liquid ring pump coupled to the suction line, the liquid ring pump comprising a chamber and an impeller mounted within the chamber; a non-return valve arranged to permit fluid to flow into the chamber via the suction line and to prevent or oppose fluid flow out of the chamber to the suction line; a gas line coupled to the liquid ring pump such that a gas may flow into the liquid ring pump via the gas line, the gas line coupled to the liquid ring pump between the non-return valve and the chamber; a valve disposed on the gas line; and a controller configured to control the valve.

The controller may be configured to open the valve within a first predetermined time period from activation of the liquid ring pump.

The liquid ring pump may further comprise a shaft upon which the impeller is mounted. The system may further comprise a motor configured to drive the shaft. The controller may be configured to activate the liquid ring pump by controlling the motor to rotate the shaft.

The controller may be configured to open the valve at least for some time while the non-return valve is closed. The controller may be configured to close the valve a second predetermined time period after opening the valve. The controller may be configured to close the valve in response to determining that the non-return valve is open.

The non-return valve may be disposed on the suction line. The gas line may be coupled to the suction line between the non-return valve and an inlet of the liquid ring pump.

The liquid ring pump may comprise an inlet manifold. The non-return valve may be integrated in the inlet manifold. The gas line may be coupled to the inlet manifold between the chamber and the integrated non-return valve in its closed position. The integrated non-return valve may comprises an annular flange defining an opening, and an object movable between a first position and a second position, wherein in the first position the object is located away from the opening so as to not block the opening, and in the second position the object abuts the annular flange so as to block the opening. The gas line may be coupled to the inlet manifold between the annular flange and the chamber.

The system may further comprise a silencer disposed on the gas line.

In a further aspect, the present disclosure provides a liquid ring pump comprising an inlet manifold and a chamber fluidly connected to the inlet manifold. The inlet manifold comprises an integrated non-return valve, and a gas inlet between the integrated non-return valve in its closed position and the chamber.

The integrated non-return valve may comprise an annular flange defining an opening, and an object movable between a first position and a second position, wherein in the first position the object is located away from the opening so as to not block the opening, and in the second position the object abuts the annular flange so as to block the opening. The gas inlet may be between the annular flange and the chamber.

In a further aspect, the present disclosure provides a control method for controlling a system. The system accords to any preceding aspect. The method comprises activating the liquid ring pump, and, after activating the liquid ring pump and while the non-return valve is closed, opening the valve such that a gas flows into the liquid ring pump via the gas line.

The method may further comprise, thereafter, closing the valve and opening the non-return valve.

The gas may be air or an inert gas. The valve may be a solenoid valve.

In any of the above aspects, the system may further comprise a pump configured to pump an operating liquid to the liquid ring pump via an operating liquid line. The controller may be a controller selected from the group of controllers consisting of a proportional controller, an integral controller, a derivative controller, a proportional-integral controller, a proportional-integral-derivative controller, a proportional-derivative controller, and a fuzzy logic controller. The system may further comprise an operating liquid recycling system configured to recycle operating liquid in the exhaust fluid of the liquid ring pump back into the liquid ring pump. The operating liquid recycling system may comprise a separator configured to separate operating liquid from the exhaust fluid of the liquid ring pump. The operating liquid recycling system may comprise a cooling means configured to cool the recycled operating liquid prior to the recycled operating liquid being received by the liquid ring pump.

DETAILED DESCRIPTION

Figure 1:
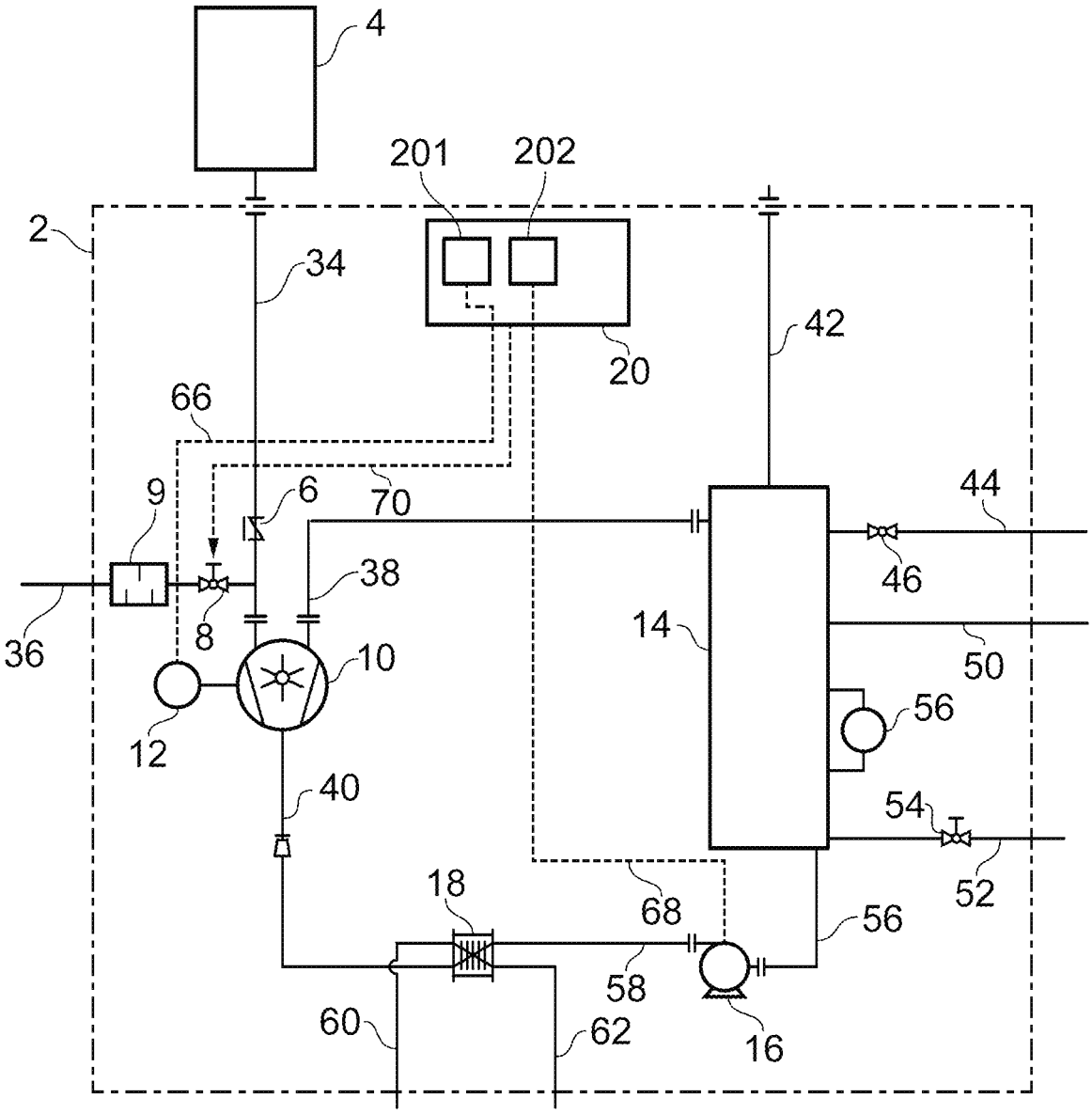
FIG. 1 is a schematic illustration (not to scale) showing a vacuum system.

FIG. 1 is a schematic illustration (not to scale) showing a vacuum system 2. The vacuum system 2 is coupled to a facility 4 such that, in operation, the vacuum system 2 establishes a vacuum or low-pressure environment at the facility 4 by drawing gas (for example, air) from the facility 4.

In this embodiment, the vacuum system 2 comprises a non-return valve 6, a first valve 8, a silencer 9, a liquid ring pump 10, a motor 12, a separator 14, a pump system 16, a heat exchanger 18, and a controller 20.

The facility 4 is connected to a gas inlet of the liquid ring pump 10 via a suction or vacuum line or pipe 34.

In this embodiment, the non-return valve 6 is disposed on the suction line 34. The non-return valve 6 is disposed between the facility 4 and the liquid ring pump 10.

The non-return valve 6 is configured to permit the flow of fluid (e.g. a gas such as air) from the facility 4 to the liquid ring pump 10, and to prevent or oppose the flow of fluid in the reverse direction, i.e. from the liquid ring pump 10 to the facility 4.

The gas inlet of the liquid ring pump 10 is further connected to an air (or gas) pipe 36 (which may also be referred to as an air (or gas) line) via which air can be fed into the gas inlet of the liquid ring pump 10. In this embodiment, the air pipe 36 is coupled to the suction line 34 between the non-return valve 6 and the gas inlet of the liquid ring pump 10.

In this embodiment, the non-return valve 6 does not prevent or oppose air flow to the liquid ring pump 10 via the air pipe 36. The air pipe 36 may be considered to by-pass the non-return valve 6.

The first valve 8 is disposed on the air pipe 36. The silencer 9 is disposed on the air pipe 36. The first valve 8 is disposed between the suction line 34 and the silencer 9. The silencer 9 is disposed between the first valve 8 and an inlet of the suction line 34.

The first valve 8 may be a solenoid valve.

The silencer 9 may also be referred to as a muffler. The silencer 9 is an acoustic device configured to reduce the loudness of the sound pressure within the air pipe 36 created by the liquid ring pump 10 drawing in air through the air pipe 36.

In this embodiment, the liquid ring pump 10 is a single-stage liquid ring pump.

The gas inlet of the liquid ring pump 10 is connected to the suction line 34. A gas outlet of the liquid ring pump 10 is connected to an exhaust line or pipe 38. The liquid ring pump 10 is coupled to the heat exchanger 18 via a first operating liquid pipe 40. The liquid ring pump 10 is configured to receive the operating liquid from the heat exchanger 18 via the first operating liquid pipe 40. The liquid ring pump 10 is driven by the motor 12. Thus, the motor 12 is a driver of the liquid ring pump 10.

Figure 2:
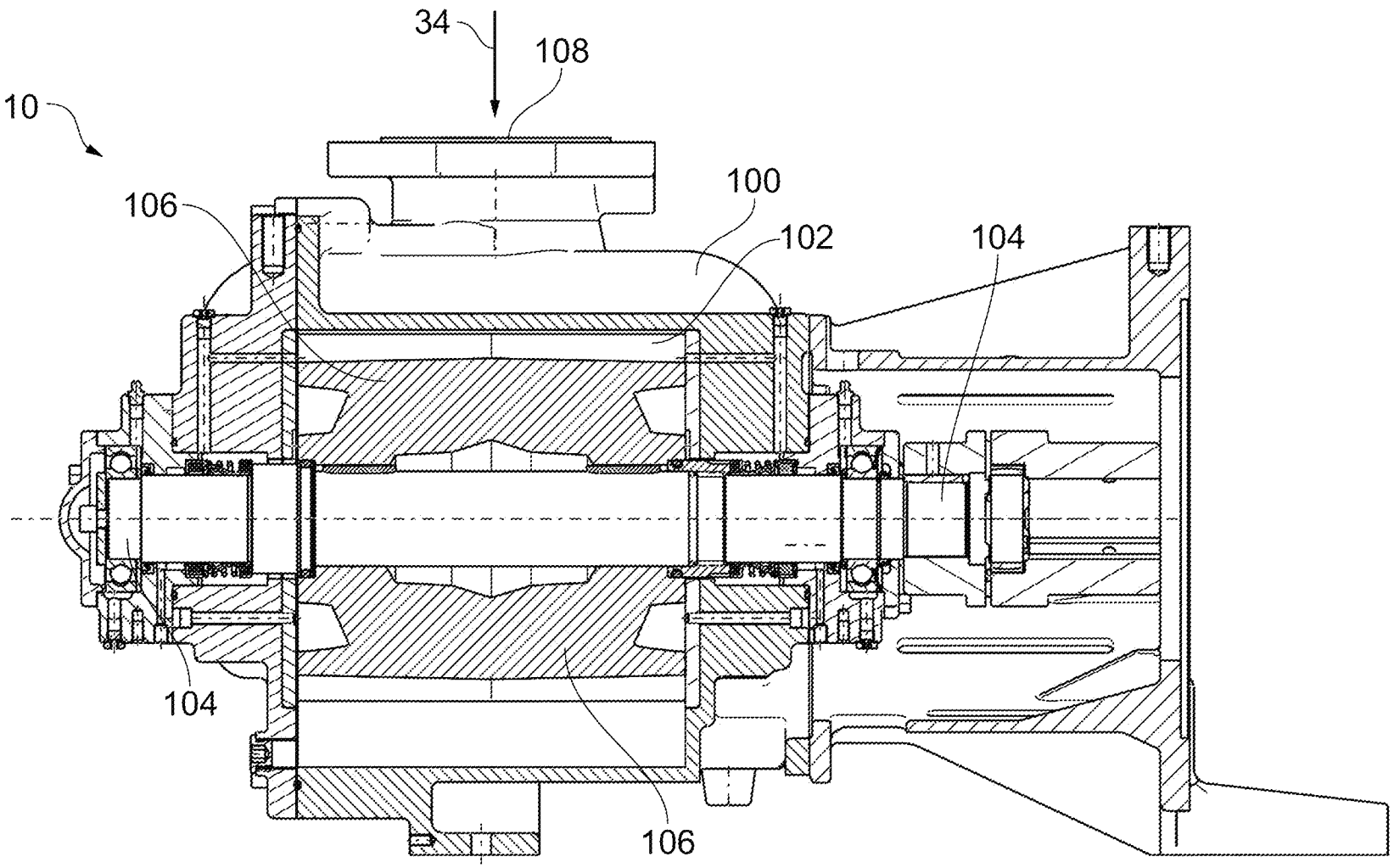
FIG. 2 is a schematic illustration (not to scale) of a liquid ring pump.

FIG. 2 is a schematic illustration (not to scale) of a cross section of an example liquid ring pump 10. The remainder of the vacuum system 2 will be described in more detail later below after a description of the liquid ring pump 10 shown in FIG. 2.

In this embodiment, the liquid ring pump 10 comprises a housing 100 that defines a substantially cylindrical chamber 102, a shaft 104 extending into the chamber 102, and an impeller 106 fixedly mounted to the shaft 104. The gas inlet 108 of the liquid ring pump 10 (which is coupled to the suction line 34) is fluidly connected to a gas intake of the chamber 102. The gas outlet (not shown in FIG. 2) of the liquid ring pump 10 is fluidly connected to a gas output of the chamber 102.

During operation of the liquid ring pump 10, the operating liquid is received in the chamber 102 via the first operating liquid pipe 40. In some embodiments, operating liquid may additionally be received via the suction line 34 via a spray nozzle. Also, the shaft 104 is rotated by the motor 12, thereby rotating the impeller 106 within the chamber 102. As the impeller 106 rotates, the operating liquid in the chamber 102 (not shown in the Figures) is forced against the walls of the chamber 102 thereby to form a liquid ring that seals and isolates individual volumes between adjacent impeller vanes. Also, gas (such as air) is drawn into the chamber 102 from the suction line 34 via the gas inlet 108 and the gas intake of the chamber 102. This gas flows into the volumes formed between adjacent vanes of the impeller 106. The rotation of the impeller 106 compresses the gas contained within the volume as it is moved from the gas intake of the chamber 102 to the gas output of the chamber 102, where the compressed gas exits the chamber 102. Compressed gas exiting the chamber 102 then exits the liquid ring pump via the gas outlet and the exhaust line 38.

Returning now to the description of FIG. 1, the exhaust line 38 is coupled between the gas outlet of the liquid ring pump 10 and an inlet of the separator 14. The separator 14 is connected to the liquid ring pump 10 via the exhaust line 38 such that exhaust fluid (i.e. compressed gas, which may include water droplets and/or vapour) is received by the separator 14.

The separator 14 is configured to separate the exhaust fluid received from the liquid ring pump 10 into gas (e.g. air) and the operating liquid. Thus, the separator 14 provides for recycling of the operating liquid.

The gas separated from the received exhaust fluid is expelled from the separator 14, and the vacuum system 2, via a system outlet pipe 42.

In this embodiment, the separator 14 comprises a further inlet 44 via which the separator 14 may receive a supply of additional, or "top-up", operating liquid from an operating liquid source (not shown in the Figures). A second valve 46 is disposed along the further inlet 44. The second valve 46 is configured to control the flow of the additional operating liquid into the separator 14 via the further inlet 44. The second valve 46 may be a solenoid valve.

The separator 14 comprises three operating liquid outlets. A first operating liquid outlet of the separator 14 is coupled to the pump system 16 via a second operating liquid pipe 48 such that operating liquid may flow from the separator 14 to the pump system 16. A second operating liquid outlet of the separator 14 is coupled to an overflow pipe 50, which provides an outlet for excess operating liquid. A third operating liquid outlet of the separator 14 is coupled to a drain or evacuation pipe 52, which provides a line via which the separator can be drained of operating liquid. A third valve 54 is disposed along the evacuation pipe 52. The third valve 54 is configured to be in either an open or closed state thereby to allow or prevent the flow of the operating liquid out of the separator 14 via the evacuation pipe 52, respectively. The third valve 54 may be a solenoid valve.

The separator 14 further comprises a level indicator 56 which is configured to provide an indication of the amount of operating liquid in the separator 14, e.g. to a human user of the vacuum system 2. The level indicator 56 may include, for example, a transparent window through which a user may view a liquid level within a liquid storage tank of the separator 14.

In this embodiment, in addition to being coupled to the separator 14 via the second operating liquid pipe 48, the pump system 16 is coupled to the heat exchanger 18 via a third operating liquid pipe 58. The pump system 16 comprises a pump (e.g. a centrifugal pump) and a motor configured to drive that pump. The pump system 16 is configured to pump operating liquid out of the separator 14 via the second operating liquid pipe 48, and to pump that operating liquid to the heat exchanger 18 via the third operating liquid pipe 58.

The heat exchanger 18 is configured to receive relatively hot operating liquid from the pump system 16, to cool that relatively hot operating liquid to provide relatively cool operating liquid, and to output that relatively cool operating liquid.

In this embodiment, the heat exchanger 18 is configured to cool the relatively hot operating liquid flowing through the heat exchanger 18 by transferring heat from that relatively hot operating liquid to a fluid coolant also flowing through the heat exchanger 18. The operating liquid and the coolant are separated in the heat exchanger 18 by a solid wall via which heat is transferred, thereby to prevent mixing of the operating liquid with the coolant. The heat exchanger 18 receives the coolant from a coolant source (not shown in the Figures) via a coolant inlet 60. The heat exchanger 18 expels coolant (to which heat has been transferred) via a coolant outlet 62.

The heat exchanger 18 comprises an operating liquid outlet from which the cooled operating liquid flows (i.e. is pumped by the pump system 16). The operating liquid outlet is coupled to the first operating liquid pipe 40. Thus, the heat exchanger 18 is connected to the liquid ring pump 10 via the first operating liquid pipe 40 such that, in operation, the cooled operating liquid is pumped by the pump system 16 from the heat exchanger 18 to the liquid ring pump 10.

The controller 20 may comprise one or more processors. In this embodiment, the controller 20 comprises two variable frequency drives (VFD), namely a first VFD 201 and a second VFD 202. The first VFD 201 is configured to control the speed of the motor 12. The first VFD 201 may comprise an inverter for controlling the motor 12. The second VFD 202 is configured to control the speed of the motor of the pump system 16. The second VFD 202 may comprise an inverter for controlling the motor of the pump system 16.

The controller 20 is connected to the motor 12 via the first VFD 201 and via a first connection 66 such that a control signal for controlling the motor 12 may be sent from the controller 20 to the motor 12. The first connection 66 may be any appropriate type of connection including, but not limited to, an electrical wire or an optical fibre, or a wireless connection. The motor 12 is configured to operate in accordance with the control signal received by it from the controller 20. Control of the motor 12 by the controller 20 is described in more detail later below with reference to FIG. 3.

The controller 20 is connected to the pump system 16 via the second VFD 202 and via a second connection 68 such that a control signal for controlling the pump system 16 may be sent from the controller 20 to the motor of the pump system 16. The second connection 68 may be any appropriate type of connection including, but not limited to, an electrical wire or an optical fibre, or a wireless connection. The pump system 16 is configured to operate in accordance with the control signal received by it from the controller 20.

The controller 20 is further connected to the first valve 8 via a third connection 70 such that a control signal for controlling the first valve 8 may be sent from the controller 20 to the first valve 8. The third connection 70 may be any appropriate type of connection including, but not limited to, an electrical wire or an optical fibre, or a wireless connection. The first valve 8 is configured to operate in accordance with the control signal received by it from the controller 20. Control of the first valve 8 by the controller 20 is described in more detail later below with reference to FIG. 3.

The controller 20 may also be connected to the second valve 46 and the third valve 54 via respective connections (not shown in the Figures) such that a control signals for controlling the second and third valves 46, 54 may be sent from the controller 20 to the second and third valves 46, 54.

Thus, an embodiment of the vacuum system 2 is provided.

Apparatus, including the controller 20, for implementing the above arrangement, and performing the method steps to be described later below, may be provided by configuring or adapting any suitable apparatus, for example one or more computers or other processing apparatus or processors, and/or providing additional modules. The apparatus may comprise a computer, a network of computers, or one or more processors, for implementing instructions and using data, including instructions and data in the form of a computer program or plurality of computer programs stored in or on a machine-readable storage medium such as computer memory, a computer disk, ROM, PROM etc., or any combination of these or other storage media.

An embodiment of a control process performable by the vacuum system 2 will now be described with reference to FIG. 3. It should be noted that certain of the process steps depicted in the flowchart of FIG. 3 and described below may be omitted or such process steps may be performed in differing order to that presented below and shown in FIG. 3. Furthermore, although all the process steps have, for convenience and ease of understanding, been depicted as discrete temporally-sequential steps, nevertheless some of the process steps may in fact be performed simultaneously or at least overlapping to some extent temporally.

Figure 3:
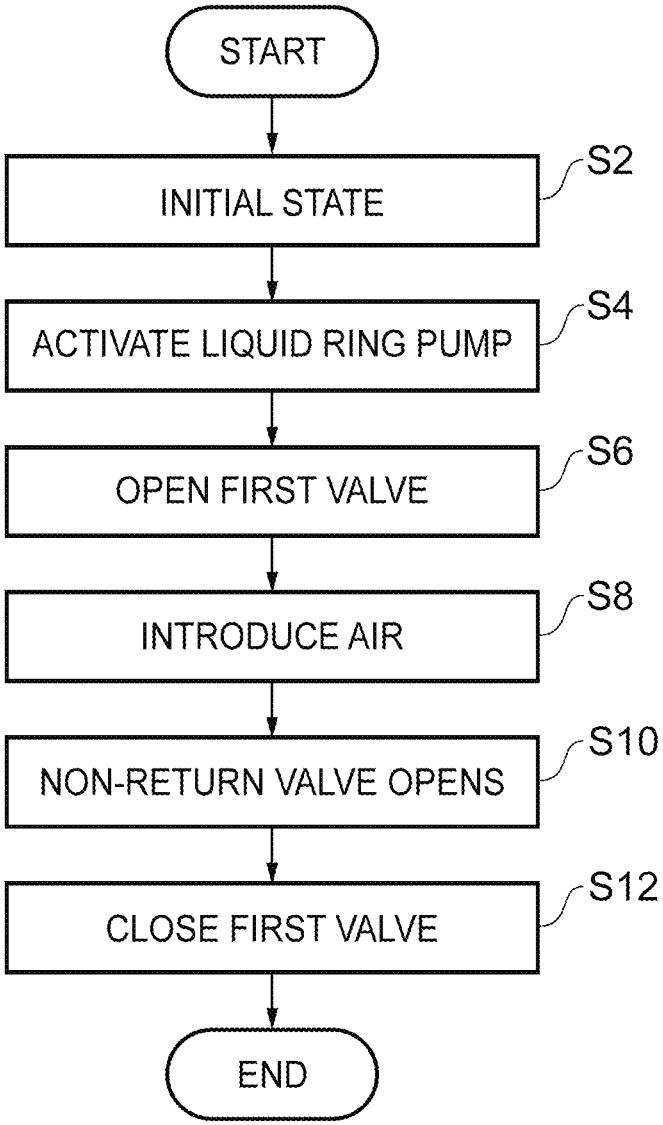
FIG. 3 is a process flow chart showing certain steps of a process performable by the vacuum system.

FIG. 3 is a process flow chart showing certain steps of an embodiment of a control process implemented by the vacuum system 2.

At step s2, the vacuum system 2 is in an initial state. In this embodiment, in the initial state of the vacuum system 2, the liquid ring pump 10 is "off" or inactive (i.e. the motor 12 is not driving the liquid ring pump 10), the non-return valve 6 is closed, and the first valve 8 is closed.

In this embodiment, in the initial state, gas pressure inside the chamber 102 of the liquid ring pump 10 is higher than the gas pressure within the suction line 34 and at the facility 4. Gas from inside the chamber 102 of the liquid ring pump 10 tends to flow back into the suction line 34 as a result of the pressure difference. This gas flow tends to close the non-return valve 6, and the pressure difference across the non-return valve 6 tends to hold the non-return valve 6 in its closed position. In its closed position, the non-return valve 6 prevents gas which is inside the chamber 102 from flowing from the chamber 102 to the facility 4 through the suction line 34. The non-return valve 6 in its closed position also prevents operating liquid which is inside the chamber 102 from flowing from the chamber 102 to the facility 4 through the suction line 34.

At step s4, the controller 20 activates the liquid ring pump 10, i.e. the liquid ring pump 10 is "on". The liquid ring pump 10 may be activated to meet a demand of the facility 4, e.g. a demand that gas be pumped from the facility 4.

In this embodiment, the controller 20 controls, via the first VFD 201 and via the first connection 66, the motor 12 to drive the liquid ring pump 10. Thus, the motor 12 rotates the shaft 104, thus rotating the impeller 106 within the chamber 102. The rotation of the impeller 106 tends to cause a reduction of gas pressure within the chamber 102. This reduction of gas pressure within the chamber 102 tends to be rapid, for example, for example, without bleeding in air via the air pipe 36, gas pressure within the chamber may drop to its operating state (e.g. vacuum pumping state) within about 1.5 seconds.

Although the reduction of gas pressure within the chamber 102 caused by activation of the liquid ring pump 10 tends to cause the non-return valve 6 to open, the non-return valve 6 may nevertheless remain closed for some time (e.g. up to ten seconds, or up to five seconds), or open at a slow speed, after the activation of the liquid ring pump 10. This may be caused by, for example, the still existing pressure difference over the non-return valve 6, or by sticking of the non-return valve 6.

At step s6, the controller 20 controls, via the third connection 70, the first valve 8 to open.

Preferably, the first valve 8 is opened at the same time that the liquid ring pump 10 is activated. In other words, preferably, steps s4 and s6 are performed substantially simultaneously. Nevertheless, the first valve 8 may be opened either before or after the activation of the liquid ring pump 10, e.g. within a predetermined time period of starting up the liquid ring pump 10.

At step s8, the liquid ring pump 10 draws air into the chamber 102 via its gas inlet 108. Air is drawn into the liquid ring pump 10 through the air pipe 36, via the open first valve 8 and the silencer 9. Air tends to be drawn into the liquid ring pump 10 through the air pipe 36 as a result of the reduced gas pressure within the chamber 102 caused by activation of the liquid ring pump 10. The silencer 9 tends to reduce noise associated with the liquid ring pump 10 drawing in air via the air pipe 36.

A rapid drop in pressure within the chamber 102 of the liquid ring pump 10, e.g. upon start-up/activation of the liquid ring pump 10, may result in the occurrence of cavitation within the liquid ring pump 10 and/or cause the liquid ring pump to make noise. The introduction of air into the liquid ring pump 10 at step s8 advantageously tends to slow the pressure drop within the chamber 102 upon activation of the liquid ring pump 10. For example, in some embodiments, the introduction of air into the liquid ring pump 10 at step s8 may increase the time taken for the gas pressure within the chamber to drop to its operating state (e.g. vacuum pumping state) by about 1 second (e.g. from about 1.5 seconds to about 2.5 seconds). Thus, the likelihood of cavitation occurring and/or noise tends to be reduced.

At step s10, the non-return valve 6 opens. In this embodiment, the non-return valve 6 opens at some time after the activation of the liquid ring pump 10 and the opening of the first valve 8. The delay between the activation of the liquid ring pump 10 and the full opening of the non-return valve 6 may be a relatively short time, e.g. less than or equal to ten seconds, or less than or equal to five seconds. The delay between the activation of the liquid ring pump 10 and the full opening of the non-return valve 6 may be caused by the non-return valve 6 sticking to a valve seat (i.e. being stuck closed), or by the pressure difference across the non-return valve 6.

In this embodiment, the reduced gas pressure within the chamber 102 caused by activation of the liquid ring pump 10 tends to cause the non-return valve 6 to open. In other words, the pressure difference across the non-return valve 6 at step s10 tends to open the non-return valve 6. With the non-return valve 6 open, the liquid ring pump 10 draws gas into the liquid ring pump 10 from the facility 4. This flow of gas tends to maintain the non-return valve 6 in its open position.

Thus, at step s10 the vacuum system 2 may establish a vacuum or low-pressure environment at the facility 4 by the liquid ring pump 10 drawing gas from the facility 4.

At step s12, the controller 20 controls, via the third connection 70, the first valve 8 to close, thereby preventing air from flowing into the gas inlet 108 via the air pipe 36.

In some embodiments, the first valve 8 is closed a predetermined time period after the first valve 8 was opened (at step s6). The predetermined time period may be any appropriate time period for example at time period that is less than or equal to 15 seconds, or less than or equal to 10 seconds, or less than or equal to 5 seconds. For example, the predetermined time period may be 5 s, 6 s, 7 s, 8 s, 9 s, 10 s, 11 s, 12 s, 13 s, 14 s, or 15 s. This advantageously tends to reduce noise. In some embodiments, a timer (e.g. a countdown timer) may be implemented to open the first valve 8 for the predetermined time period.

In some embodiments, the first valve 8 is closed responsive to the controller 20 detecting or determining that the non-return valve 6 is fully open. The non-return valve 6 being fully open may be determined or detected by the controller 20 using measurements from a sensor that is configured to measure the position or state of the non-return valve 6.

Thus, an embodiment of an anti-cavitation process implemented by the vacuum system 2 is provided.

The above described method may be performed automatically, under control of the controller.

The non-return valve advantageously tends to prevent or oppose undesirable back flow of gas and operating liquid, and tends to be particularly beneficial for the liquid ring pump operated using VFD.

In the above embodiments, the vacuum system comprises the elements described above with reference to FIG. 1. However, in other embodiments the vacuum system comprises other elements instead of or in addition to those described above. Also, in other embodiments, some or all of the elements of the vacuum system may be connected together in a different appropriate way to that described above. For example, in some embodiments, multiple liquid ring pumps may be implemented.

In the above embodiments, the non-return valve 6, the first valve 8, and the liquid ring pump 10 are separate, individual devices. However, in some embodiments, the liquid ring pump may have an integrated non-return valve, e.g. in the inlet manifold of the liquid ring pump. In some embodiments, the liquid ring pump may have an integrated first valve, e.g. in the inlet manifold of the liquid ring pump. In some embodiments, the liquid ring pump may have both an integrated non-return valve and an integrated first valve, e.g. in the inlet manifold of the liquid ring pump.

What will now be described is an embodiment of a liquid ring pump 10 comprising an inlet manifold having an integrated non-return valve 6. The first valve 8 is coupled to the inlet manifold. For ease of understanding, like reference numerals refer to like elements. The liquid ring pump 10 described below with reference to FIGS. 4 to 6 may be controlled using the method of FIG. 3, described in more detail earlier above.

Figure 4:
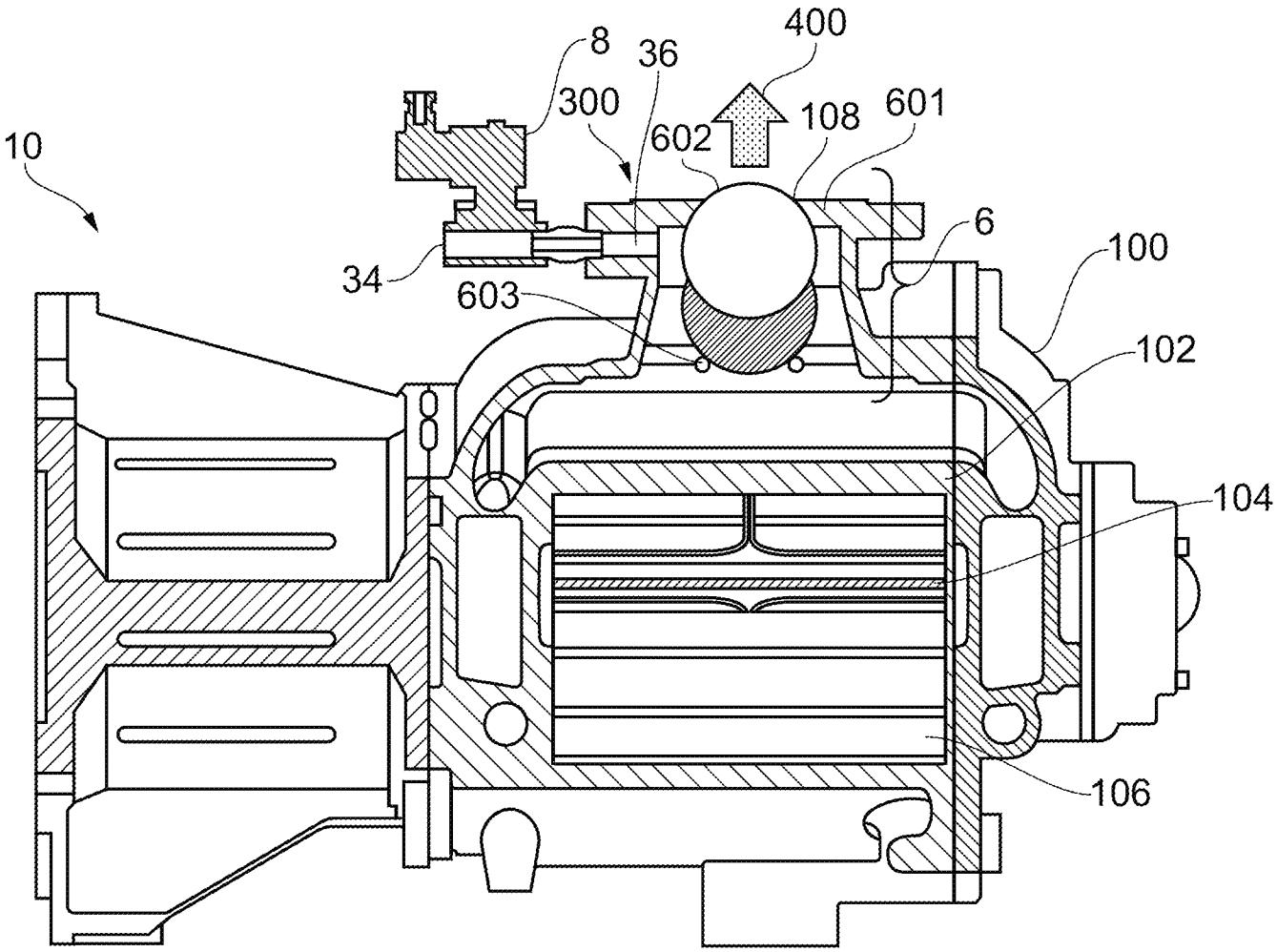
FIGS. 4 to 6 are schematic illustrations (not to scale) showing a liquid ring pump having an integrated non-return valve, at respective different stages of the process of FIG. 3.

FIG. 4 is a schematic illustration (not to scale) showing a cross section of a liquid ring pump 10. The liquid ring pump 10 comprises the housing 100, the chamber 102, the shaft 104, the impeller 106, and the gas inlet 108 which are arranged as described in more detail earlier above with reference to FIG. 2. The gas inlet is connected to the suction line 34 (not shown in FIG. 4).

In this embodiment, the liquid ring pump 10 comprises an inlet manifold 300 in which the non-return valve 6 is integrated and to which the air pipe 36 is attached.

The non-return valve 6 comprises an annular flange 601 defining a substantially circular opening, a ball 602, and a holder 603.

In this embodiment, the annular flange 601 is disposed on an inner side of a wall of the inlet manifold 300 at or proximate to the inlet 108. The annular flange 601 comprises a chamfered rim circumscribing the opening. The chamfered ring acts as a valve seat. In this embodiment, the annular flange 601 is integrally formed with the wall of the inlet manifold 300.

In this embodiment, the ball 602 is a substantially spherical object disposed within the inlet manifold 602. The ball 602 is movable between a first position in which it is held by the holder 603 and is not blocking the opening (i.e. corresponding to an open position of the non-return valve 6), and a second position in which it is in contact with the annular flange 601 and is thus blocking the opening (i.e. corresponding to a closed position of the non-return valve 6). Thus, in the first position the ball 602 is configured to permit fluid flow through the opening, and in the second position the ball 602 is configured to prevent or oppose fluid flow through the opening. In other words, the ball 602 is able to act as a plug for the opening.

The holder 603 is configured to hold the ball 602 when the ball 602 is in the first position. In this embodiment, the holder 603 comprises two protrusions (e.g. rods). The protrusions extend from an internal surface of the inlet manifold 300 into the interior (i.e. a flow channel) of the inlet manifold 300.

The air pipe 36 is coupled to an air inlet of the inlet manifold 300 located at a point after the annular flange 601, i.e. between the annular flange 601 and the chamber 102. Thus, when the ball 602 is in its second position in contact with the annular flange 601 and is blocking the opening, air (or other gas) can be introduced into the chamber 102 via the air pipe 36. The first valve 8 is coupled to the air pipe 36 at or proximate to the inlet manifold 300.

FIG. 4 shows the liquid ring pump 10 when the vacuum system 2 is its initial state, i.e. at step s2 of the process of FIG. 3. The non-return valve 6 is closed and the first valve 8 is closed. In the initial state, gas pressure inside the chamber 102 of the liquid ring pump 10 is higher than the gas pressure within the suction line 34 and at the facility 4. Gas from inside the chamber 102 of the liquid ring pump 10 tends to flow back into the suction line 34 as a result of the pressure difference. This gas flow is indicated in FIG. 4 by an arrow and the reference numeral 400. This gas flow 400 tends to move the ball 602 into its second position in contact with the annular flange 601, and to the pressure difference across the ball 602 tends to retain the ball 602 against the annular flange 601. Thus, the gas inlet 108 is blocked by the ball 602.

Figure 5:
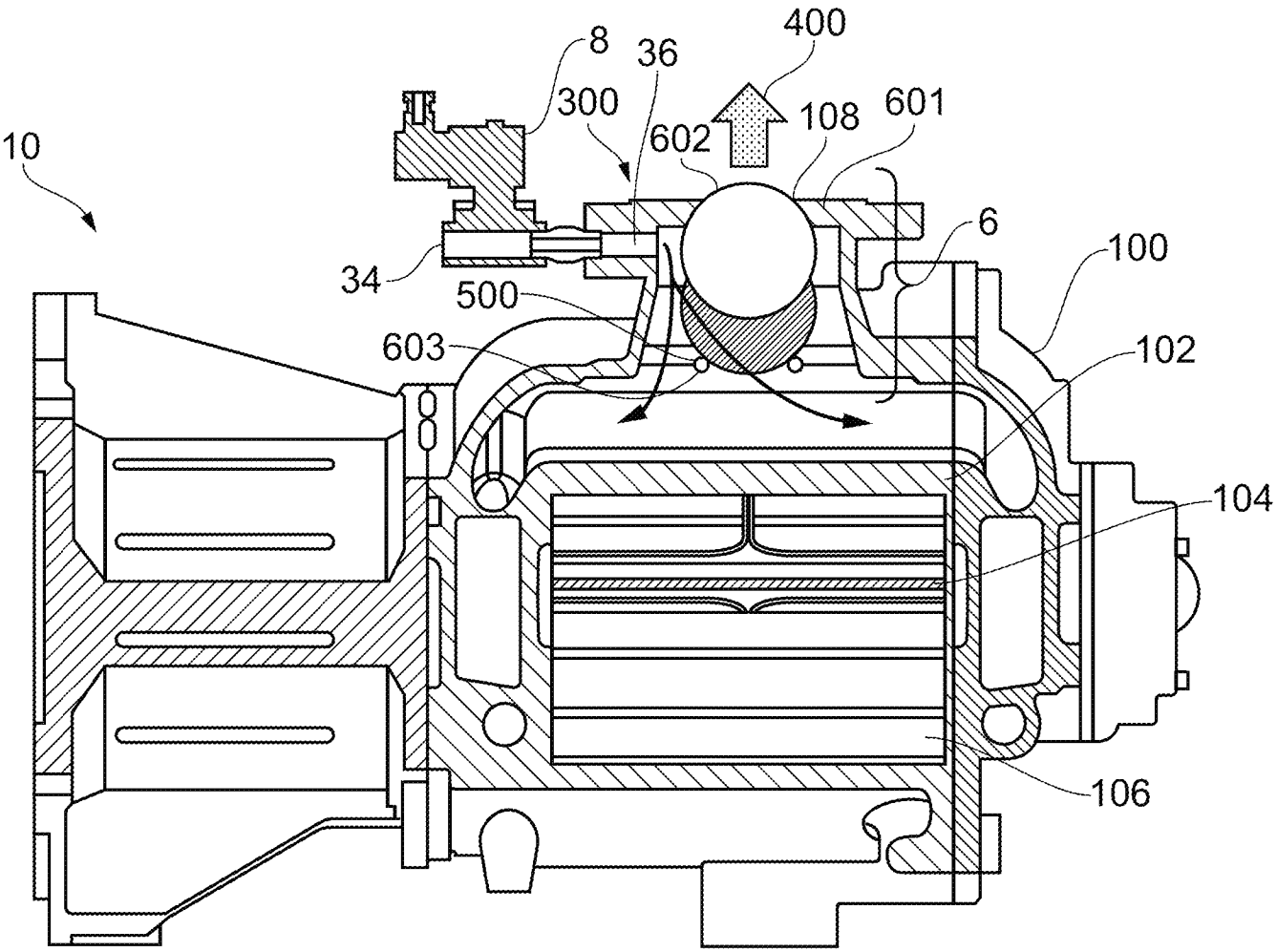

FIG. 5 shows the liquid ring pump 10 at step s8 of the process of FIG. 3. In FIG. 5, the liquid ring pump 10 has been activated, the first valve 8 is open, and the non-return valve 6 remains closed. Also, as indicated in FIG. 5 by arrows and the reference numerals 500, air is drawn into the liquid ring pump 10 through the air pipe 36 via the open first valve 8. In this embodiment, air 500 flows into the chamber 102 after, or downstream, of the closed non-return valve 6, i.e. after the annular flange 601 and the ball 602 in contact therewith.

Figure 6:
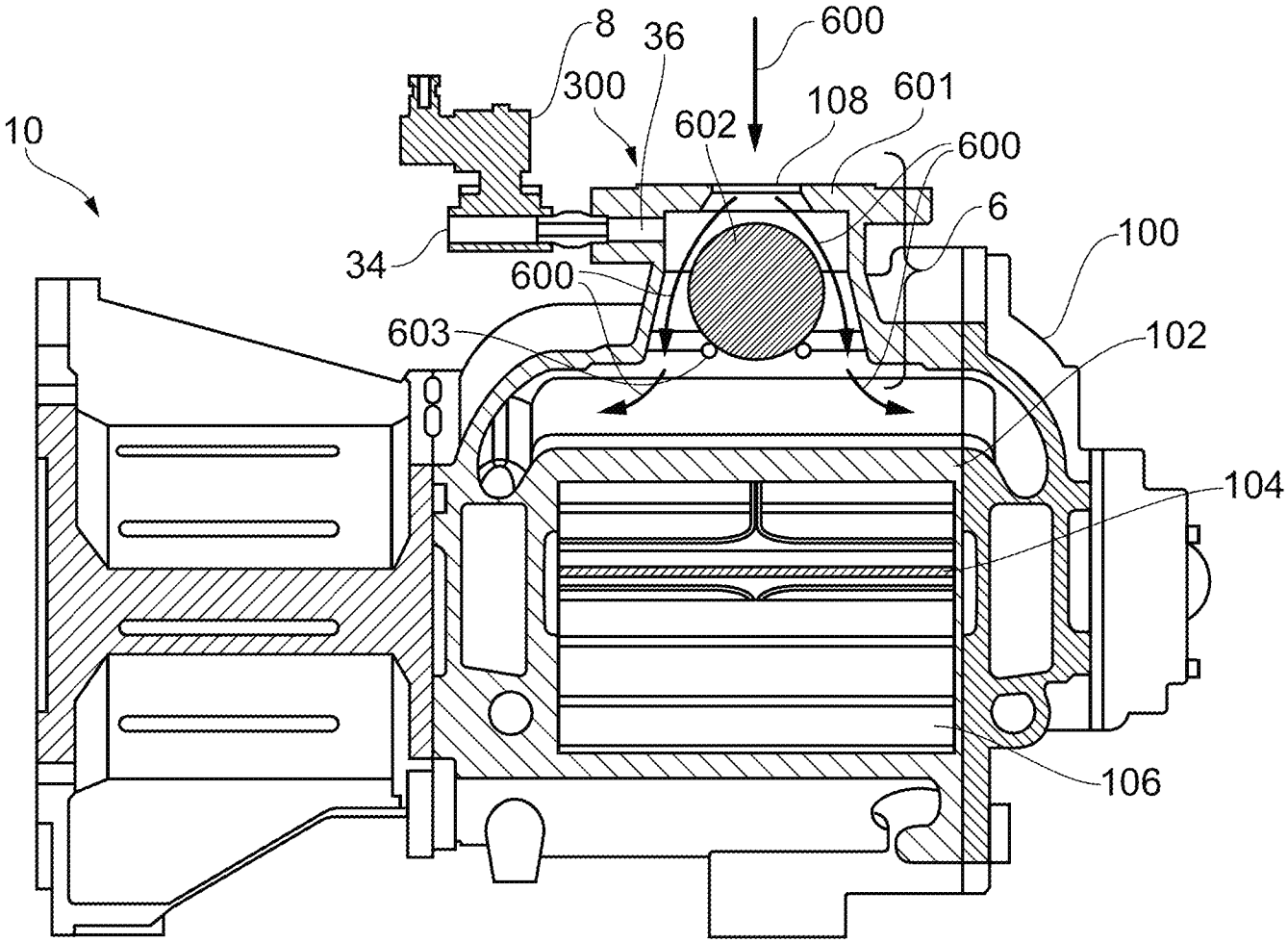

FIG. 6 shows the liquid ring pump 10 at step s12 of the process of FIG. 3. In FIG. 6, the liquid ring pump 10 is activated, the non-return valve 6 is open, and the first valve 8 is closed. Also, as indicated in FIG. 6 by arrows and the reference numerals 600, the liquid ring pump 10 draws gas 600 into the liquid ring pump 10 from the facility 4 via the suction line 34. This flow of gas tends to retain the ball 602 against the holder 603. The closed first valve 8 prevents air from flowing into the inlet manifold 300 via the air pipe 36.

Thus, an embodiment of a liquid ring pump comprising an inlet manifold having an integrated non-return valve is provided.

The inlet manifold of the liquid ring pump having an integral or integrated non-return valve advantageously tends to reduce or eliminate use of a separate section of pipe that contains a non-return valve. This avoidance of a separate non-return valve pipe section tends to mean that fewer connections (e.g. joints) are formed between the liquid ring pump and the source of the gas being pumped by the liquid ring pump. This in turn tends to reduce the overall installation height. Also, the risk of leakage tends to be reduced due to the above-mentioned lower number of connections. Thus, efficiency of the liquid ring pump tends to be improved. Also, the material cost associated with the liquid ring pump tends to be reduced, for example because the use of a separate section of pipe containing a non-return valve is reduced or eliminated. Furthermore, the integration of the non-return valve also tends to safeguard against human error during installation of the liquid ring pump at a location.

In addition, a non-return valve integrated in the inlet manifold advantageously tends to restrict flow of gas to a lesser extent than a non-return valve contained in a separate section of pipe.

In the above embodiments, the system comprises a silencer. However, in other embodiments, the silencer is omitted.

In the above embodiments, the air is bled into the liquid ring pump via the air pipe and the first valve. However, in other embodiments, a different gas is introduced into the liquid ring pump. For example, an inert gas, such as nitrogen, may be used. In some embodiments, the fluid (e.g. air) may be introduced into the liquid ring pump at a different location to that described above.

In the above embodiments, the non-return valve does not prevent or oppose air flow to the liquid ring pump via the air pipe. In some embodiments, the non-return valve does not significantly affect airflow to the liquid ring pump via the air pipe, and this air flow is controlled solely via the first valve. However, in other embodiments, the non-return valve may be configured such that, when the non-return valve is in its closed position, the air pipe is open such that air can flow into the liquid ring pump via the air pipe, and such that, when the non-return valve is in its open position, the air pipe is closed by the non-return valve such that air is prevented from flowing into the liquid ring pump via the air pipe.

In the above embodiments, the heat exchanger cools the operating liquid flowing therethrough. However, in other embodiments other cooling means are implemented to cool the operating liquid prior to it being received by the liquid ring pump, instead of or in addition to the heat exchanger.

In the above embodiments, a separator is implemented to recycle the operating liquid back into the liquid ring pump. However, in other embodiments a different type of recycling technique is implemented. The recycling of the operating liquid advantageously tends to reduce operating costs and water usage. Nevertheless, in some embodiments, recycling of the operating liquid is not performed. For example, the vacuum system may include an open loop operating liquid circulation system in which fresh operating liquid is supplied to the liquid ring pump, and expelled operating liquid may be discarded. Thus, the separator may be omitted.

In the above embodiments, the liquid ring pump is a single-stage liquid ring pump. However, in other embodiments the liquid ring pump is a different type of liquid ring pump, for example a multi-stage liquid ring pump.

In the above embodiments, the operating liquid is water. However, in other embodiments, the operating liquid is a different type of operating liquid, e.g. an oil.

The controller may be a proportional-integral (PI) controller, a proportional (P) controller, an integral (I) controller, a derivative (D) controller, a proportional-derivative (PD) controller, a proportional-integral-derivative controller (PID) controller, a fuzzy logic controller, or any other type of controller.

In the above embodiments, a single controller controls operation of multiple system elements (e.g. the motor). However, in other embodiments multiple controllers may be used, each controlling a respective subset of the group of elements.

In the above embodiments, the pump is controlled to regulate or modulate flow of the operating liquid into the liquid ring pump. However, in other embodiments, one or more different type of regulating device is implemented instead of or in addition to the pump, for example one or more valves for controlling a flow of operating fluid. The controller may be configured to control operation of the one or more regulating devices. In some embodiments, the operating liquid flow is not modulated or regulated, and is drawn by the pump's vacuum inlet pressure.

The invention claimed is:

1. A system comprising:
- a suction line;
- a liquid ring pump coupled to the suction line, the liquid ring pump comprising a chamber and an impeller mounted within the chamber;
- a non-return valve arranged to permit fluid to flow into the chamber via the suction line and to prevent or oppose fluid flow out of the chamber to the suction line;
- a gas line coupled to the liquid ring pump such that a gas is configured to flow into the liquid ring pump via the gas line, the gas line coupled to the liquid ring pump between the non-return valve and the chamber;
- a valve disposed on the gas line; and
- a controller configured to open the valve within a predetermined time period from activation of the liquid ring pump.

2. The system of claim 1, wherein:
- the liquid ring pump further comprises a shaft upon which the impeller is mounted;
- the system further comprises a motor configured to drive the shaft; and
- the controller is configured to activate the liquid ring pump by controlling the motor to rotate the shaft.

3. The system of claim 1, wherein the controller is configured to open the valve at least for some time while the non-return valve is closed.

4. The system of claim 1, wherein the predetermined time period is a first predetermined time period, and wherein the controller is configured to close the valve within a second predetermined time period after opening the valve.

5. The system of claim 1, wherein the controller is configured to close the valve in response to determining that the non-return valve is open.

6. The system of claim 1, wherein:
- the liquid ring pump comprises an inlet manifold;
- the non-return valve is integrated in the inlet manifold; and
- the gas line is coupled to the inlet manifold between the chamber and the integrated non-return valve in its closed position.

7. The system of claim 6, wherein:
- the integrated non-return valve comprises:
  - an annular flange defining an opening; and
  - an object movable between a first position and a second position, wherein in the first position the object is located away from the opening so as to not block the opening, and in the second position the object abuts the annular flange so as to block the opening; and
- the gas line is coupled to the inlet manifold between the annular flange and the chamber.

8. The system of claim 1, further comprising a silencer disposed on the gas line.

9. A liquid ring pump comprising:
- an inlet manifold; and
- a chamber fluidly connected to the inlet manifold; wherein:
- the inlet manifold comprises:
  - an integrated non-return valve, wherein the integrated non-return valve comprises:

an annular flange defining an opening; and an object movable between a first position and a second position, wherein the integrated non-return value is in an open position while the object is in the first position such that the object is located away from the opening so as to not block the opening, and the integrated non-return value is in a closed position while the object is in the second position such that the object abuts the annular flange so as to block the opening; and a gas inlet located between the annular flange and the chamber, and between the integrated non-return valve and the chamber when the integrated non-return valve is in the closed position.

10. A control method for controlling a system, the method comprising:

activating, by a controller of the system, a liquid ring pump of the system, wherein the liquid ring pump comprises a chamber and an impeller mounted within the chamber;

wherein the system comprises:

a suction line coupled to the liquid ring pump;

a non-return valve arranged to permit fluid to flow into the chamber via the suction line and to prevent or oppose fluid flow out of the chamber to the suction line;

a gas line coupled to the liquid ring pump such that a gas is configured to flow into the liquid ring pump via the gas line, the gas line coupled to the liquid ring pump between the non-return valve and the chamber; and a valve disposed on the gas line; and after activating the liquid ring pump and while the non return valve is closed, within a predetermined time period from activation of the fluid ring pump, opening, by the controller, the valve such that a gas flows into the liquid ring pump via the gas line.

11. The method of claim 10, the method further comprising, thereafter:

opening the non-return valve; and closing the valve.

12. The method of claim 10, wherein the gas is air or an inert gas.

* * * * *